United States Patent [19]

Polsky

[11] Patent Number: 4,488,317

[45] Date of Patent: Dec. 18, 1984

[54] PANTS-LIKE GARMENTS HAVING A SEAMLESS CROTCH CONSTRUCTION

[76] Inventor: Bernice B. Polsky, P.O. Box 112, Beverly Hills, Calif. 90213

[21] Appl. No.: 523,720

[22] Filed: Aug. 16, 1983

[51] Int. Cl.[3] ..... A41D 1/06; A41B 9/04

[52] U.S. Cl. ..... 2/227; 2/401

[58] Field of Search ..... 2/401, 227, 2/408, 409, 407, 77-83

[56] References Cited

U.S. PATENT DOCUMENTS 1,633,610 6/1927 Schneider ..... 2/401

4,371,989 2/1983 Polsky ..... 2/227

*Primary Examiner*—Doris L. Troutman

*Attorney, Agent, or Firm*—Spensley, Horn, Jubas & Lubitz

[57] ABSTRACT

A garment having a seamless crotch is described. The seamless crotch of the present invention may be used in conventional pants, such as dress pants and jeans, as well as in shorts. In conventionally lengthed pants, an essentially curved diamond-shaped crotch piece with concave edges and long tapering sections which extend down the insides of the legs of the garment is sewn into the garment. Forces generated by the assumption of a sitting position or by the raising of a leg of the wearer of the garment which would otherwise cause the garment to ride up the crotch are redirected in the area of the crotch. In the crotch piece there is no center seam along the crotch and the seams of the crotch piece curved in directions becoming transverse through the crotch so that the garment therefore does not ride up the crotch. In another embodiment a pair of shorts is described in which the crotch piece is truncated.

20 Claims, 8 Drawing Figures

PANTS-LIKE GARMENTS HAVING A SEAMLESS CROTCH CONSTRUCTION

BACKGROUND OF THE INVENTION

1. Field of the Invention

The present invention relates to the field of wearing apparel, and more particularly to garments having a pants portion.

2. Prior Art

Aesthetics and comfort are often at odds in the design of garments having a pants portion. On the one hand, it is usually desired that such a garment present a pleasing appearance while the wearer is bending, walking or otherwise moving about in a manner visible to other people. In particular, it is thought by some that jeans and dress pants worn by millions of people for everyday use should present a nonbaggy appearance and be rather form-fitting in the crotch, thigh and buttocks area. On the other hand, it is desired that such garments be comfortable to the wearer while the wearer is sitting or in any other position that might typically be assumed.

With such garments, however, it is found that the design of the garment is such that the comfort of the wearer is less than optimum. Especially, it is found that the wearer may experience some discomfort in the crotch area while sitting or crouching, even in pants in which the crotch of the garment is normally an inch or more away from the crotch while the person is standing or walking. In such positions the crotch of the pants "ride-up" to the crotch of the wearer so that the pants feel tight and uncomfortable to the wearer in the crotch area.

Prior to the present invention, the problem of providing conventional garments having a pants portion suitable for everyday use that are both aesthetically pleasing, from the point of view of not being too baggy in the crotch area, as well as comfortable in the crotch area has not been solved. Most of the previous inventions and designs have been concerned with specialized tight fitting pants or undergarments and most of these have evinced little concern for aesthetics. An exception is the invention described and claimed in U.S. Pat. No. 4,371,989 issued on Feb. 8, 1983 to the present inventor and entitled "Seamless Crotch." That patent concerns especially form fitting garments of the type generally worn for dancing, exercise or similar activities. That invention solved the problem of crotch ride-up in such garments in an aesthetically pleasing manner through the use of a crotch piece whose shape was generally that of an elongated diamond having concave edges and which was fabricated of material stretchable in at least one direction. Subsequent to the invention of U.S. Pat. No. 4,371,989, through further thorough research, the positive conclusion was reached that a crotch piece having some structural similarities to the crotch piece described in U.S. Pat. No. 4,271,989 could enhance the comfort of conventional type pants, including jeans and dress pants and also including pants having truncated leg portions, commonly referred to as shorts, in an aesthetically pleasing manner, and that such a result could be obtained in such pants with the use of a crotch piece which is nonstretchable in any direction.

SUMMARY OF THE INVENTION

The present invention is useful for garments having a pant portion such as jeans, dress pants or the like and is also useful in such garments having truncated leg portions, commonly referred to as shorts.

An object of the present invention is to provide a garment suitable for everyday use which provides more comfort to the wearer than has heretofore has been provided without compromising the aesthetical considerations in the area of the crotch.

A garment using the present invention, therefore has an essentially curved diamond-shaped or truncated diamond-shaped crotch piece sewn into the crotch area.

As used in conventional length pants, the crotch piece has long tapering points running down the insides of the legs of the garment and shorter points extending along the crotch between the front and the back.

The long tapering points of the crotch piece proceed down the inside of the legs so that the garment conforms as much as possible to the natural taper of the thighs while extra room in the crotch area is provided by the crotch piece and distributed over the crotch area from the front to the back and from side to side so that the garment does not appear to be loose or baggy when the wearer is standing or walking. As a result of its construction, such a garment made in accordance with the present invention is aesthetically pleasing.

In conventional garments, even those designed not to be form-fitting in the crotch area, the garment tends to ride up the crotch when the wearer sits down. When the wearer sits down, the back part of the garment most cover more area so that the garment naturally tends to pull downward at the back of the waist and to ride up the crotch in order to compensate for the pull. In conventional garments, this effect is accentuated by a seam running down the middle of the garment including along the entire crotch, which must absorb the entire pulling force.

In the present invention, a single piece of material traverses the crotch area from one leg to the other so that the forces are redirected on either side of the crotch along the curved seam lines attaching the crotch piece to the rest of the garment rather than along the line of the crotch itself.

A garment having such a crotch piece has pleasing aesthetic qualities. Since the crotch piece need not be of stretchable material, it may be of the same material as the rest of the garment. Further, the edges of the crotch piece, being concave, do not need to intrude into the main areas of the garment to any appreciable extent. Hence, garments such as dress pants may be made in accordance with the present invention.

DESCRIPTION OF THE PREFERRED EMBODIMENT

The present invention can be employed in garments having pants portions, whether such garments are intended for dress or casual use. The garments employing the present invention may be somewhat form-fitting in the buttocks and thigh areas, such as jeans, or more conservatively tailored such as dress pants. The present invention may also be used in garments having truncated leg portions, such as shorts.

The seamless crotch construction of the present invention can be used with any material, whether stretchable or nonstretchable. Thus the crotch piece of the present invention may be made from the same material as the rest of the garment. The seamless crotch construction of the present invention significantly increases the comfort of the wearer.

Figure 1:
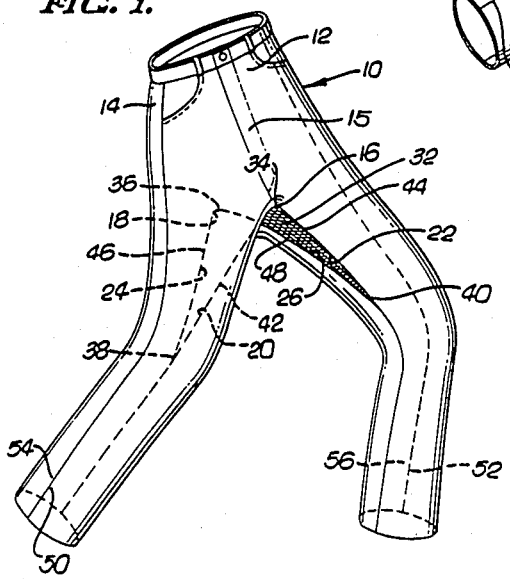
FIG. 1 is a perspective view of a conventional length pair of pants made according to the present invention.

A conventional length garment, such as shown in FIG. 1 will be described as a preferred embodiment of the present invention. For purposes of the present description, the pants-like garment 10 shown in FIG. 1 comprises three essential pieces of fabric. A front section 12 and a rear section 14 each having trunk and leg areas form the main part of the pants-like garment 10. In practice the front section 12 and rear section 14 are often each made of two or more pieces of fabric and the front section is often fabricated with a fly 15. The crotch points 16 and 18 of the front and rear sections 12 and 14 respectively at which the leg sections separate from the trunk are located higher up, i.e., nearer to the waist 30 than they are in conventional pants-type garments. This is because the remainder of the garment which proceeds around the crotch of the wearer is comprised of a third or crotch piece 32. Crotch piece 32 is a generally curved diamond-shaped piece of fabric having concave edges. The shorter points of the diamond form the front point 34 and the rear point 36 of the crotch piece and are connected respectively to the crotch point 16 on the front section 12 of the garment 10 and the crotch point 18 on the rear section 14 of the garment 10. The longer points 38 and 40 of the crotch piece 32 extend down the insides of the legs of the garment 10 and are attached to the inside edges 20 and 22 of the front section 12, and 24 and 26 of the rear section 14.

It will be noticed that the crotch piece 32 is large in the crotch area but quickly tapers down along its concave edges, to long tapering portions which conform to the shape of the thighs. This unique construction of the concave edged crotch piece 32 prevents the garment from riding-up the crotch of the wearer when the wearer moves his or her leg without detracting in any way from the pleasing aesthetic qualities the garment may possess.

A more detailed description of the present invention will now be given with respect to FIGS. 1 through 4. The main part of the garment 10 is formed by the front section 12 and the rear section 14, each of which has trunk and leg areas. Each section 12 or 14 may be fabricated from two or more pieces of material. Each said section 12 or 14 is generally shaped in the form of an inverted V, and has the general shape of a typical pair of pants viewed from the front or the rear. The front section 12 may be provided with a fly 15.

The inside edges 20 and 22 of the front section 12 meet at a crotch point 16. The crotch point 16 is closer to the waist 30 on the front piece 12 than would be a crotch point on a front piece for a pair of pants which does not employ the present invention but consists merely of a front section and a rear section. The construction of the rear section 14 is very similar to the front section 12 except that the crotch point 18 is slightly closer to the waist 30 than is the crotch point 16 of the front piece 12.

Figure 4:
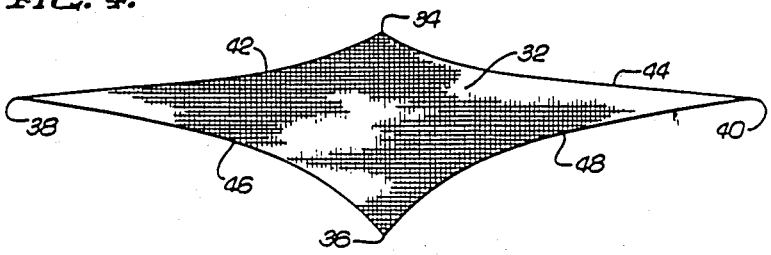
FIG. 4 is a pattern of the crotch piece used in the pair of pants of FIG. 1.
Figure 5:
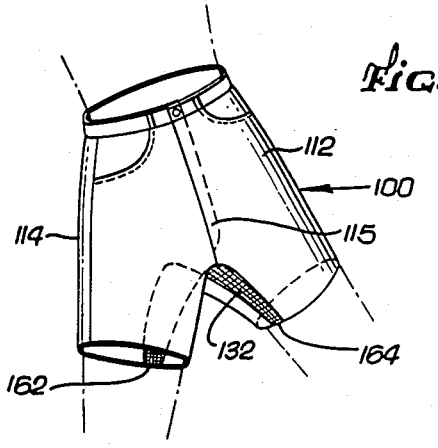
FIG. 5 is a perspective view of a short pair of pants made according to the present invention.
Figure 6:
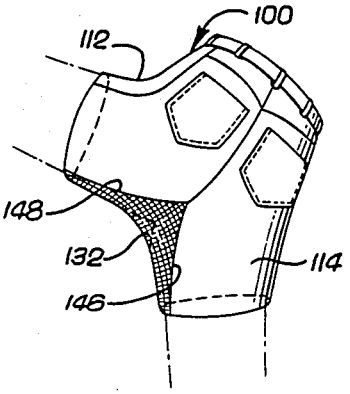
FIG. 6 is a perspective view of the pair of pants of FIG. 5 particularly illustrating how the crotch piece does not ride up the crotch of the wearer.
Figure 7:
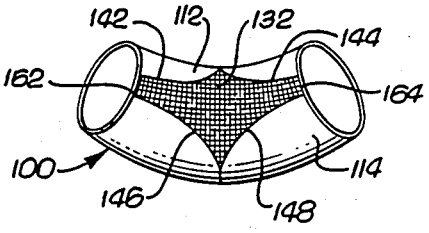
FIG. 7 is a perspective view of the pair of pants of FIG. 5 looking from the bottom upward.

As seen in FIG. 4, the crotch piece 32 is of a generally elongated curved diamond-shape and is formed of a single piece of cloth. The front edges 42 and 44 and the rear edges 46 and 48 of the crotch piece 32 are all concave. In the preferred embodiment, the longitudinal axis of the crotch piece 32, i.e., the line connecting the point 38 with the point 40 along the surface of the crotch piece 32 is approximately three to four times as long as the crotch axis between the front point 34 and the rear point 36. It will also be noticed that the front point 34 is a shorter less tapered point than is the rear point 36 of the crotch piece 32 with the longitudinal axis intersecting the crotch axis at a point which is closer to the front point 34 than to the rear point 36 by approximately a factor of two.

The front point 34 of the crotch piece 32 and its adjacent front edges 42 and 44 are connected to the front section 12 while the rear point 36, and its adjacent rear edges 46 and 48 are connected to the rear section 14.

In particular, the front point 34 is attached to the crotch point 16 with the adjacent front edge 42 of the crotch piece 32 attached along the inside edge 20 of the front section 12 and the adjacent front edge 44 attached along the inside edge 22 of the front section 12.

The rear point 36 of the crotch piece 32 is attached to the crotch point 18 of the rear section 14 with the adjacent rear edge 46 attached along the inside edge 24 of the rear section 14 and the adjacent rear edge 48 attached along the inside edge 26 of the rear section 14.

In the construction of the crotch piece 32 as described, the concave rear edges 46 and 48 adjacent to the rear point 36 are slightly longer than the concave front edges 42 and 44 adjacent to the front point 34. This difference in length compensates for the fact that the crotch point 18 of the rear section 14 is located higher up or nearer to the waist 30 than is the crotch point 16 of the front section 12, thus making the inside edges 24 and 26 of the rear section 14 slightly longer than the inside edges 20 and 22 of the front section 12. The difference in length between the inside edges 20 and 24 for one leg and 22 and 26 for the other is equal to the difference in length between the concave edges 46 and 42 on the one hand and 48 and 44 on the other. The result is that when the crotch piece 32 is attached to the front section 12 and rear section 14 as has been described, the distance from the points 38 and 40 of the crotch piece 32 to the bottom of the legs of the front section 12 is the same as that to the bottoms of the legs of the rear section 14. Below the points 38 and 40, therefore, the front section 12 and the rear section 14 can be attached to each other along the remainder of their inside edges 20 and 24 for one leg and 22 and 26 for the other leg. The construction of the garment 10 is completed by stitching the corresponding outside edges 50 of the front section 12 to 54 of the rear section 14 and 52 of the front section 12 to 56 of the rear section 14.

It will be appreciated that the shape and relative dimensions of the crotch piece 32 complement the natural shape and structure of the body in the area in which crotch piece 32 is used. Thus, the distance between the longitudinal axis of the crotch piece 32 and the rear point 36 is greater than that between the longitudinal axis and the front point 34 (and similarly the crotch point 18 of the rear section 14 is slightly closer to the waist 30 than the crotch point 16 of the front section 12), because the crotch area of the human body extends more rearward than forward when considered with respect to the center line of the insides of the legs. Similarly, the upper thigh of a person generally increases in circumference in the direction toward the trunk of the body. Thus, the crotch piece 32 has long tapering portions that run down the inside of the legs of the person wearing the garment. Yet, to cover the crotch area these tapering portions must appreciably widen in the area of the crotch. The concave edges 42, 44, 46 and 48 perform this function and result in a crotch piece 32 which is well suited for meeting the requirements set by the basic dimensions and shape of the upper thigh and trunk area of the body.

Figure 2:
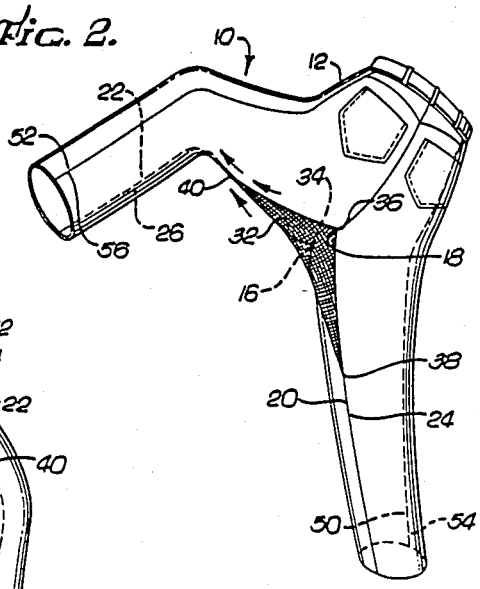
FIG. 2 is a perspective view of the pair of pants of FIG. 1 particularly illustrating how the crotch piece does not ride up the crotch of the wearer.
Figure 3:
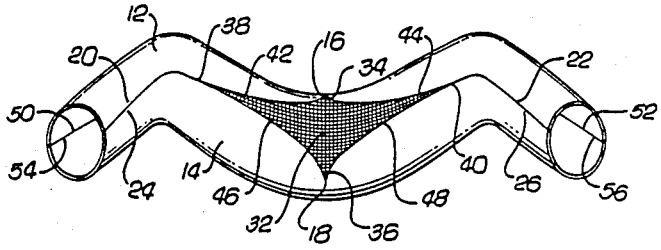
FIG. 3 is a perspective view of the pair of pants of FIG. 1 looking from the bottom upward.

The characteristic of a garment having the above-described construction in not riding-up the crotch of a wearer can be seen with respect to FIG. 2. In a typical garment, an action by the wearer in which one leg moves with respect to the trunk area and to the other leg tends to exert a pull on the garment in the crotch and buttocks area. This is true because when the leg is so moved, such as shown in FIG. 2, the effective distance between the waist and the back of the knee, for example, measured along the contour of the body, increases. As the knee is raised, such as is shown in FIG. 2, there is a pull from the middle of the back of the waist around the buttocks and crotch area to the inside and back of the leg and down the leg. Thus, a movement such as is shown in FIG. 2 would tend to make a conventional garment ride-up the crotch. This effect, of course, is more pronounced the more form-fitting the garment is in the buttocks and thigh area.

In a garment employing the above-described construction of a seamless crotch, however, the pull exerted on the garment along the leg portions is transmitted to the crotch piece 32 along the concave edges 42, 44, 46 and 48 of the crotch piece and there is no crotch ride-up. This can be understood by reference to the arrows in FIG. 2. It is believed that a pulling force exerted at a point on the seam is transmitted along a significant portion of the length of the seam so that the tapering portion of the crotch piece 32 is pulled generally in a direction along its longitudinal axis as shown by the arrows in FIG. 2. As this longitudinal axis in the area of the crotch is across the crotch, the pull on the crotch piece 32 is to a large extent across the crotch rather than along the crotch as in a conventional garment. Thus a garment employing the above-described construction of the present invention does not ride-up the crotch during leg movements.

In the particular embodiment shown in FIG. 2, the rear point 36 of the crotch piece 32 is located at a distance below the waist 30 of the garment. For aesthetic purposes, it may be desired not to locate rear point 36 as shown in FIG. 2. Rear point 36 may be located closer to waist 30 than shown in FIG. 2 and may in fact be located at waist 30, in which case rear section 14 is in fact two separated partial rear sections.

A second embodiment of the present invention is shown in FIGS. 5 through 8. The garment shown in FIGS. 5 through 8 is a pair of pants having truncated leg portions, commonly known as shorts. The main part of the garment 100 is formed by the front section 112 and rear section 114, each of which has a trunk area and truncated leg areas. The sections 112 and 114, except for the truncated leg portions, may be fabricated as described with respect to the front and rear sections 12 and 14 of the embodiment of FIGS. 1 through 4.

Figure 8:
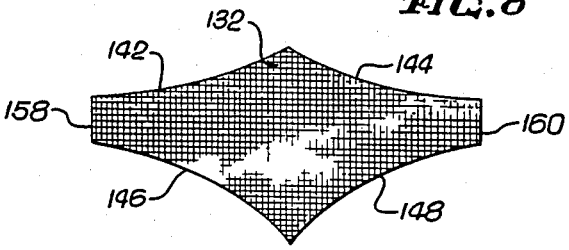
FIG. 8 is a pattern of the crotch piece used in the pair of pants of FIG. 5.

As seen particularly in FIG. 8, the crotch piece 132 is hexagonal. The front edges 142 and 144 do not meet the rear edges 146 and 148 respectively at points. Instead, front edge 142 and rear edge 146 meet transverse edge 158 at opposite ends of transverse edge 158 and front edge 144 and rear edge 148 meet transverse edge 160 at opposite ends of transverse edge 160. Transverse edges 158 and 160 form part of the bottom edges 162 and 164 of the truncated leg portions of the garment. Notwithstanding that the concave edges 142, 144, 146 and 148 are shorter than the corresponding concave edges 42, 44, 46 and 48 of the crotch piece 32 used with respect to conventional length pants, it is found that the advantageous features which exist in the embodiment showing FIGS. 1 through 4 are also obtained in this embodiment. The crotch piece 132 redirects the forces in the area of the crotch while not detracting in the least and indeed, enhancing the appearance of the shorts in which it was used in a manner similar to that which has been described with respect to crotch piece 32.

It will be appreciated from the above descriptions of presently preferred embodiments that other configurations are possible and within the scope of the present invention. For example, the length of the longitudinal axis of the crotch piece need not be three to four times the length of the crotch axis, as in the preferred embodiment. As another example, the preferred embodiments were described in terms of conventional garments having a pants portion. However designs in which an integral top part is fabricated with the bottom part of a garment, such as bib overalls or jump suits are also within the scope of the present invention. Thus, the present invention is not intended to be limited to the particular embodiment specifically discussed hereinabove.

I claim:

1. In a garment having a pants section with a waistline and leg portions, the improvement comprising:

a generally polygonal-shaped crotch piece having a pair of concave front edges and a pair of concave rear edges, one said front edge and one said rear edge located on each side of the center of said garment, said front edges meeting at a point toward the front center of the garment below the waistline and extending from said point generally in a direction away from the front of the garment and the waistline, said rear edges meeting at a point at the rear of the garment and extending from said point generally in a direction away from the rear of the garment and the waistline, said front and rear edges on each side of said garment approaching one another as said edges extend generally away from said waistline.

2. The improvement as in claim 1 wherein said front and rear edges on each side of said garment meet at a point along the leg portion of the garment so that said polygonal-shaped crotch piece is generally shaped like a diamond having concave edges.

3. The improvement as in claim 2 wherein said crotch piece is generally shaped like an elongated diamond having concave edges, the long axis of which extends from the point along one leg where said front and rear edges on one side of said garment meet along said crotch piece to the point along the other leg where said front and rear edges on the other side of said garment meet.

4. The improvement of claim 1 wherein said crotch piece is fabricated of a substantially nonstretchable material.

5. The improvement of claim 2 wherein said crotch piece is fabricated of a substantially nonstretchable material.

6. The improvement of claim 3 wherein said crotch piece is fabricated of substantially nonstretchable material.

7. The improvement of claim 3 wherein said long axis is three to four times as long as the short axis, said short axis extending from the point at which said front edges meet along said crotch piece to the point at which said rear edges meet.

8. The improvement of claim 7 wherein said long axis and said short axis intersect at a point on said crotch piece closer to said point where said front edges meet than to said point where said rear edges meet.

9. The improvement of claim 1 in a garment having truncated leg portions wherein said crotch piece has transverse edges connecting said front and rear edges on each side of said garment, said transverse edges forming part of the bottom edges of the truncated leg portions of the garment.

10. The improvement of claim 9 wherein said crotch piece is fabricated of a substantially nonstretchable material.

11. The improvement of claim 1 in a garment having a fly wherein said point at which said front edges meet is located below said fly.

12. The improvement of claim 1 wherein said rear edges meet at a point below the waistline.

13. A garment having a pants portion, said garment comprising:

a front piece having a trunk area and legs, the inside edges of said legs forming an inverted V and meeting said trunk area at a front piece crotch point;

a rear piece having a trunk area and legs, the inside edges of said legs forming an inverted V and meeting said trunk area at a rear piece crotch point, said front piece and said rear piece being joined together at the outside edges of said legs and trunk area; and a generally polygonal-shaped crotch piece having a pair of concave front edges and a pair of corresponding concave rear edges, said front edges meeting at a first point and said rear edges meeting at a second point opposite said first point, said first point being joined to said front piece at said front piece crotch point, said second point being joined to said rear piece at said rear piece crotch point, each said front edge being joined to an inside edge of a leg of said front piece, each said rear edge being joined to an inside edge of a leg of said rear piece.

14. A garment as in claim 13 wherein the corresponding front edges and rear edges joined to the corresponding inside edges of said front piece and said rear piece meet at third and fourth points opposite one another, said crotch piece thereby being generally diamond-shaped, said inside edges of said legs of said front and rear pieces being joined together at said third and fourth points and along their lengths to their bottoms.

15. A garment as in claim 13 wherein said front piece and rear piece have truncated legs and wherein said crotch piece has transverse edges joining the corresponding front and rear edges.

16. A garment as in claim 13 wherein said front piece, said rear piece and said crotch piece are each fabricated of substantially nonstretchable material.

17. A garment as in claim 14 wherein the distance along said crotch piece between said third and fourth points is between three and four times as long as the distance along said crotch piece between said first and second points.

18. The improvement of claim 1 wherein said crotch piece is fabricated of a woven or knitted material.

19. The improvement of claim 2 wherein said crotch piece is fabricated of a woven or knitted material.

20. A garment as in claim 13 wherein said front piece, said rear piece and said crotch piece are each fabricated of woven or knitted material.

* * * * *